US006223110B1

(12) United States Patent
Rowe et al.

(10) Patent No.: US 6,223,110 B1
(45) Date of Patent: Apr. 24, 2001

(54) SOFTWARE ARCHITECTURE FOR AUTONOMOUS EARTHMOVING MACHINERY

(75) Inventors: Patrick Rowe; Jorgen Pedersen; Anthony Stentz, all of Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 0 days.

(21) Appl. No.: 09/172,420

(22) Filed: Oct. 14, 1998

Related U.S. Application Data

(60) Provisional application No. 60/068,214, filed on Dec. 19, 1997.

(51) Int. Cl.[7] ..... G06F 7/70; G06G 7/76

(52) U.S. Cl. ..... 701/50; 56/10.2 H; 56/10.2 R; 37/234; 37/245; 111/177

(58) Field of Search ..... 701/50; 250/202; 239/1, 11, 155; 37/231, 232, 348; 180/168; 340/901, 903, 988, 994, 686.1, 687, 679, 684; 111/178, 903, 170, 177; 702/2, 5; 56/10.2 R, 102 A, 102 B, 10.2 H, 10.2 G, 10.2 F; 172/2, 7, 10

(56) References Cited

U.S. PATENT DOCUMENTS

| | | | | |
|---|---|---|---|---|
| 4,211,921 | * | 7/1980 | Kanetou et al. | 250/202 |
| 4,630,773 | * | 12/1986 | Ortlip | 239/1 |
| 4,807,131 | | 2/1989 | Clegg | 701/50 |

(List continued on next page.)

FOREIGN PATENT DOCUMENTS

| | | |
|---|---|---|
| 9102853 | 3/1991 | (WO) . |
| 9530880 | 11/1995 | (WO) . |
| 9701005 | 1/1997 | (WO) . |

OTHER PUBLICATIONS

J.K.Rosenblatt & C.E. Thorpe, Combining Goals in a Behavior–Based Architecture, Proceedings of the International Conference on Intelligent Robots & Systems, 6 pages, Aug. 1995.

J. Rosenblatt, DAMN: A Distributed Architecture for Mobile Navigation, Journal of Experimental and Theoretical Artificial Intelligence, vol. 9, No. 2/3, pp. 339–360, Apr.–Sep., 1997.

(List continued on next page.)

*Primary Examiner*—Jacques H. Louis-Jacques
(74) *Attorney, Agent, or Firm*—Blackwell Sanders Peper Martin

(57) ABSTRACT

In accordance with the present invention, a modular architecture to organize and coordinate components that are needed to automate earthmoving tasks, and to coordinate the flow of data between the components is disclosed. The architecture includes three main subdivisions: a sensor pipeline, sensor data consumers, and motion planners and executors. The sensor pipeline receives raw sensor data from perceptual sensors such as a laser rangefinder or radar system, and converts the data into a form which is usable by the other system components. Sensor data can also be represented in the form of an elevation map of the surrounding terrain for other software components to use. Any number and types of sensor systems may be added to the software architecture depending on requirements and the capabilities of the system. The sensor data consumers use the sensor data as input to specific algorithms to produce information regarding the machine's environment for use by other system components. A motion planner receives information provided by the sensor data consumers, and delivers output commands go to controllers on the machine. The motion planner also computes and delivers commands to the sensor systems on the machine. Additional planners may be added at this level to coordinate other system behaviors and actions.

17 Claims, 3 Drawing Sheets

U.S. PATENT DOCUMENTS

| | | | | |
|---|---|---|---|---|
| 5,065,326 | | 11/1991 | Sahm | 701/50 |
| 5,288,167 | | 2/1994 | Gafffard et al. | 404/84.05 |
| 5,410,479 | * | 4/1995 | Coker | 701/28 |
| 5,446,980 | | 9/1995 | Rocke | 37/348 |
| 5,630,101 | | 5/1997 | Sieffert | 710/11 |
| 5,650,800 | * | 7/1997 | Benson | 345/173 |
| 5,659,985 | | 8/1997 | Stump | 37/348 |
| 5,684,476 | * | 11/1997 | Anderson | 340/988 |
| 5,721,679 | * | 2/1998 | Monson | 701/207 |
| 5,751,576 | * | 5/1998 | Monson | 700/83 |
| 5,915,313 | * | 6/1999 | Bender et al. | 111/178 |
| 5,924,371 | * | 7/1999 | Flamme et al. | 111/177 |
| 5,955,973 | * | 9/1999 | Anderson | 340/988 |
| 5,978,723 | * | 11/1999 | Hale et al. | 701/50 |
| 5,991,694 | * | 11/1999 | Gudat et al. | 702/2 |
| 5,995,895 | * | 11/1999 | Watt et al. | 701/50 |
| 6,041,582 | * | 3/2000 | Tiede et al. | 56/10.2 A |
| 6,070,538 | * | 6/2000 | Flamme et al. | 111/170 |

OTHER PUBLICATIONS

R. Simmons, Concurrent Planning & Execution for a Walking Robot, Proceedings of the International Conference on Intelligent Robotics & Automation, 6 pages, Apr. 1991.

R. Simmons, Structured Control for Autonomous Robots, IEEE Transactions of Robotics & Automation, vol. 10, No. 1, Feb., 1994.

W. Wettergreen, H. Pangels, & J. Bares, Behavior–Based Gait Execution for the Dante II Walking Robot, Proceedings of the International Conference on Intelligent Robots & Systems, Aug. 1995.

* cited by examiner

SOFTWARE ARCHITECTURE FOR AUTONOMOUS EARTHMOVING MACHINERY

This application claims benefit of provisional application No. 60/068,214, filed Dec. 19, 1997.

TECHNICAL FIELD

This invention relates generally to a software architecture for an earthmoving machine and, more particularly, to a software architecture for controlling an earth moving machine in an autonomous mode.

BACKGROUND ART

Machines such as excavators, backhoes, front shovels, and the like are used for earthmoving work. These earthmoving machines have work implements which consist of boom, stick, and bucket linkages. The boom is pivotally attached to the excavating machine at one end, and to its other end is pivotally attached a stick. The bucket is pivotally attached to the free end of the stick. Each work implement linkage is controllably actuated by at least one hydraulic cylinder for movement in a vertical plane. An operator typically manipulates the work implement to perform a sequence of distinct functions which constitute a complete earthmoving cycle.

In a typical work cycle, the operator first positions the work implement at a dig location, and lowers the work implement downward until the bucket penetrates the soil. Then the operator executes a digging stroke which brings the bucket toward the excavating machine. The operator subsequently curls the bucket to capture the soil. To dump the captured load, the operator raises the work implement, swings it transversely to a specified dump location, and releases the soil by extending the stick and uncurling the bucket. The work implement is then returned to the trench location to begin the work cycle again.

There is an increasing demand in the earthmoving industry to automate the work cycle of an earthmoving machine for several reasons. Unlike a human operator, an automated earthmoving machine remains consistently productive regardless of environmental conditions and prolonged work hours. The automated earthmoving machine is ideal for applications where conditions are unsuitable or undesirable for humans. An automated machine also enables more accurate excavation and compensates for lack of operator skill.

The major components for automating earthmoving, e.g., digging material, loading material into trucks, and recognizing truck positions and orientations, are currently under development. All of these functions are performed by software in computers. A software architecture is needed to consolidate and coordinate the numerous software functions of a fully autonomous earthmoving machine.

Accordingly, the present invention is directed to overcoming one or more of the problems as set forth above.

DISCLOSURE OF THE INVENTION

In accordance with the present invention, a modular architecture to organize and coordinate components that are needed to automate earthmoving tasks, and to coordinate the flow of data between the components is disclosed. The architecture includes three main subdivisions: a sensor pipeline, sensor data consumers, and motion planners and executors. The sensor pipeline receives raw sensor data from perceptual sensors such as a laser rangefinder or radar system, and converts the data into a form which is usable by the other system components. Sensor data can also be represented in the form of a terrain elevation map of the surrounding terrain for other software components to use. Any number and types of sensor systems may be added to the software architecture depending on requirements and the capabilities of the system. The sensor data consumers use the sensor data as input to specific algorithms to produce information regarding the machine's environment for use by other system components. A motion planner receives information provided by the sensor data consumers, and delivers output commands to controllers on the machine. The motion planner also computes and delivers commands to the sensor systems on the machine. Additional planners may be added at this level to coordinate other system behaviors and actions.

BEST MODE FOR CARRYING OUT THE INVENTION

Figure 1:
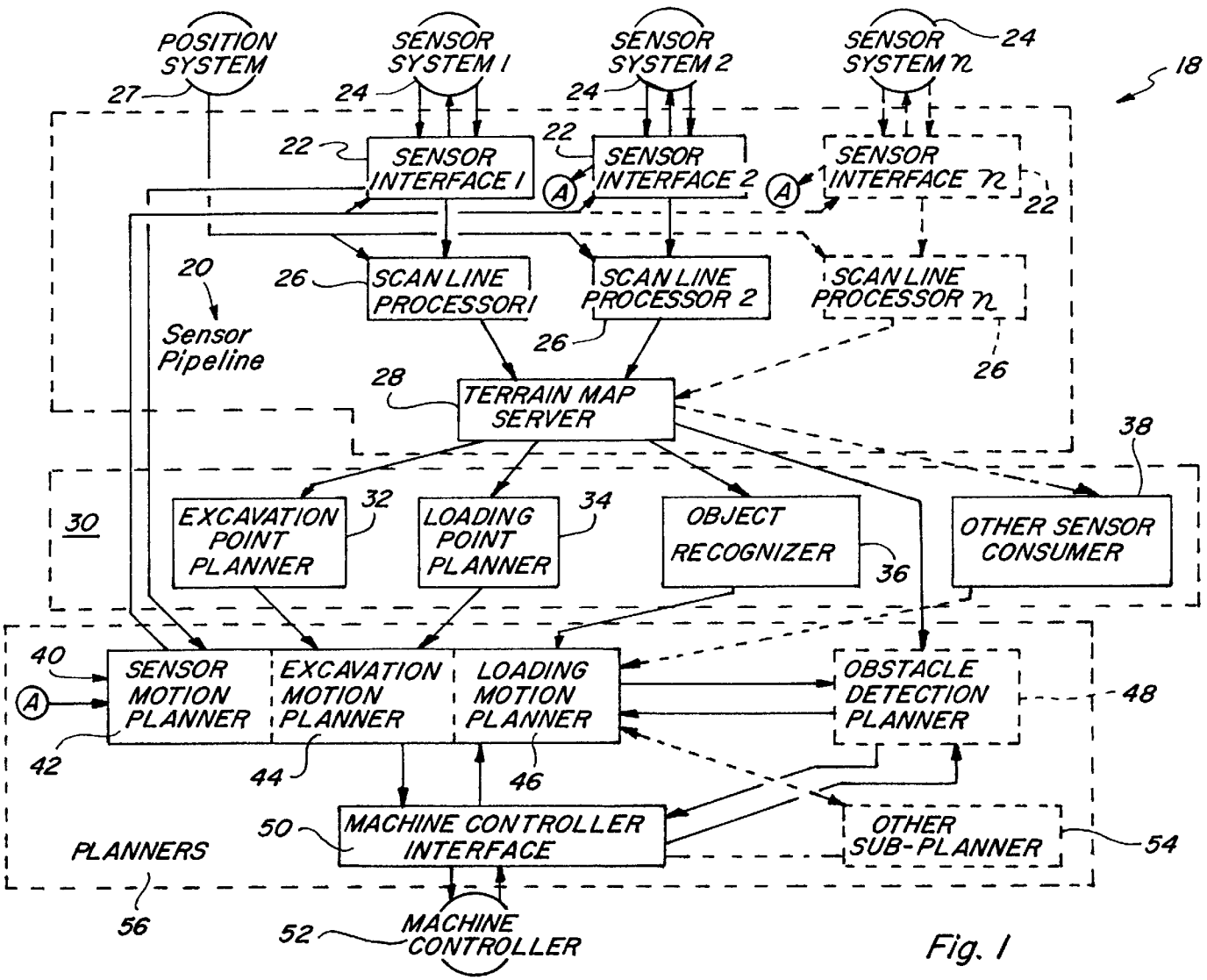
FIG. 1 is a block diagram of an embodiment of software architecture according to the present invention.

Referring to the drawings, FIG. 1 shows a preferred embodiment of a software architecture 18 for autonomous control of earthmoving machinery according to the present invention. Each component in a solid box can be run separately, ideally on its own processor, to emulate the inherent parallelism of the system components. The dashed boxes and lines represent components that can be added in this software architecture 18. Circles represent any external hardware that the system communicates with, such as the perceptual sensor systems and controllers in the machine itself. The major components of the software architecture 18 are described below.

Sensor Pipeline

A sensor pipeline 20 provides an interface 22 between sensor system 24 and the software architecture 18. For example, the sensor pipeline 20 converts encoder bits to angles which may be expressed in radians or degrees, and the sensor pipeline 20 may also send commands to the sensor system 24 from a corresponding scan line processor 26. Each sensor interface 22 is unique to a particular sensor system 24. The scan line processors 26 receive data from the sensor system interfaces 22. The sensor systems 24 may be of various types including those based on radar, laser, sonar, or infrared sensors. The sensor systems 24 may also include computer simulations of perceptual sensors. The data provided by the sensor systems 24 may consist of two or three-dimensional range and/or image data corresponding to objects in the environment, as well as information regarding the state of the sensors, such as positions and velocities. Other information supplied by the sensor systems 24 may also be stored in the database. The range sensor data is typically in spherical coordinates including line of sight range, azimuth, and elevation to an object. The scan line processors 26 convert each data point to Cartesian coordinates as measured in a global reference frame that provides a common reference for the other software modules in the system. To do this, the scan line processors 26 must have information about the position and orientation of the digging machine, as well as any other angular measurements, such as the swing angle on an excavator, which are needed in the coordinate conversion. This information may be provided by a positioning system 27 on-board the machine, such as a global positioning system (GPS) receiver, inclinometers, or an inertial navigation system.

A terrain map server 28 performs an additional level of processing on the sensor data and puts it into the form of an elevation map of the surrounding terrain. This terrain map can be used by other modules in the software architecture 18, shown in FIG. 1 as sensor data consumers 30. The terrain map server 28 includes components for storing processed data from one or more scan line processors 26 in a centralized data server (not shown), and for supplying requested portions of the data to the sensor data consumers 30. The sensor data consumers 30 send queries to the terrain map server 28 specifying data for a particular location or region of interest, along with any constraints that must be met. The constraints that may be placed on the data vary depending on the type of sensor supplying the data, but may include, for example, sensor identification, resolution level, the time the data was received, and confidence level in the accuracy of the data. When a query is received, an algorithm associated with processing means in the terrain map server 28 sorts through the data beginning with the most recent data to find information meeting the specified constraints. Various types of sensor systems 24 may be connected to the terrain map server 28, and the information may be accessed by one or more sensor data consumers 30, depending on the data input, output, and storage capabilities of the terrain map server 28. A more detailed description of the terrain map server is provided in the Assignee's copending application entitled, "*Method And Apparatus For Receiving, Storing, And Distributing Three-Dimensional Range Data In An Earthmoving Environment*" (Attorney Docket No. 97-352), which was filed on the same day as the present application and is hereby incorporated by reference.

Sensor Data Consumers

The sensor data consumers 30 typically comprise software modules that require data regarding the state of the machine and the excavation environment to determine the task that should be performed and the movements to make with the machine in order to accomplish the required task as efficiently as possible. An overall excavation task, such as "dig a site for a foundation in this location", may be broken down into a series of sub-tasks, some of which are repeated until the overall task is accomplished. The functions performed by the sub-tasks include planning the overall task so that it is conducted efficiently, planning the sub-tasks, recognizing objects in the environment and determining their location and orientation, generating desired excavation shapes and locations, generating control system parameters, and determining desired unloading locations. The sub-tasks may also monitor the progress of the task, and make adjustments accordingly if there are unforeseen changes or circumstances.

One of the sub-tasks that may be incorporated is an excavation point planner 32 which plans the next excavation site depending on the shape of the terrain which is being excavated. A preferred embodiment of the excavation point planner 32 includes a planning method for earthmoving operations comprised of three different levels of processing. One of the processing levels is a coarse-level planner that uses geometry of the site and the goal configuration of the terrain to divide the excavation area into a grid-like pattern of smaller excavation regions and to determine the boundaries and sequence of excavation for each region. The next level is a refined planner wherein each excavation region is searched in the order of the excavation sequence provided by the coarse planner for the optimum excavation that can be executed. This is accomplished by choosing candidate excavations that meet geometric constraints of the machine and that are approximately within the boundaries of the region to be excavated. The refined planner evaluates the candidate excavations using a simulated model of a closed loop controller and by optimizing a cost function based on performance criteria such as volume of material excavated, energy expended, and time, to determine the optimal location and orientation of the bucket of an excavator to begin excavating the region. The third level of the excavation planner is a control scheme wherein the selected excavation is executed by a closed loop controller that controls execution of a commanded excavation trajectory by monitoring forces exerted on the bucket, stick, and boom of the excavator. Further details of this embodiment of the excavation point planner 32 is provided in the Assignee's copending application entitled, "*Method and Apparatus For Determining An Excavation Strategy*" (Attorney Docket No. 97-349), which was filed on the same day as the present application and is hereby incorporated by reference.

One of the other sub-tasks that may be performed during an excavation is a loading point planner 34 which plans where to unload the next bucket of material in a dump truck or other receptacle. The loading point planner 34 may take into account the shape of the material already in the truck or receptacle, and the desired distribution of the material, to determine the optimal location to deliver the next load. The terrain map server 28 provides data corresponding to a digital map of the load of material in the receptacle to data processing means (not shown) associated with the loading point planner 34. The load map data is typically acquired by one or more of the sensor systems 24 and is processed to include the height and shape of the material in the receptacle. A template of the ideal distribution pattern in the receptacle is also provided. Various shapes may be chosen for the template and the height data may be preprogrammed in the digital computer or calculated interactively based on user input. The template for the desired load distribution can vary from simple to more complex patterns.

In one embodiment of the loading point planner 34, the load map is divided into grid portions and a number representative of the height for each grid portion is computed. The number of grid portions depends on the desired resolution and data processing capabilities. A value representing the correlation between the ideal and the actual distribution of the load is calculated for each grid portion, and the optimal location to place the next load of material is selected from the correlation values. The values calculated by the correlation algorithm are also used for higher level planning, including selecting alternative and future loading sites. The computation for the correlation value for a particular xy location takes into account the height of the material in the grid portion corresponding to the particular xy location as well as the height of the material in the surrounding grid portions. The processing means associated with the loading point planner 34 will also estimate data for grid portions of the load map for which height data is unavailable due to problems such as noise in the sensor signal. In order to reduce processing time to compute the correlation values, the loading point planner 34 may include instructions to process only certain portions of the grid, such as the center grid portions. This method for determining the loading point is further discussed in the Assignee's copending application entitled, "*Template-Based Loading Strategy Using Perceptual Feedback*" (Attorney Docket No. 97-338), which was filed on the same day as the present application and is hereby incorporated by reference.

An object recognizor 36 is another sub-task algorithm that may be incorporated in the present software architecture to determine the position, orientation, and dimensions of the truck or other receptacle to be loaded. In one embodiment of the object recognizor 36, a method and apparatus for determining the position and orientation of objects to receive excavated materials, such as dump trucks at a construction or mining site, involves using range data which has been segmented into planar regions. In an algorithm for forming line segments that may be incorporated with the object recognizor 36, adjacent data points within a scanline are grouped into line segments. The line segments in each scanline are merged, provided the resulting line segment has an error within a threshold. The error may be calculated using least squares regression or other forms of regression. The process continues until all line segments have been merged into other line segments. Each line segment in each scanline is merged with a best fit plane if a merged plane error is within a threshold. Planes are merged into pairs of planes if a combined plane error is within a second threshold. Vectors that are normal to each plane are calculated and possible mergers of planes with similar normals are calculated. After all possible mergers are completed, the resulting planes are used by object recognition software. A search algorithm matches the object's planar regions from the range data to planar regions of one or more models that are similar to the object being recognized. A hypothesis is made consisting of a set of matches of scene planar regions to model planar regions that are generated by the searching technique. The next step is to verify that the range planar regions are a good representation of the object and to determine the location of the vertices of the planar object's corners. The verification process uses tolerances on the dimensions of the object and the angular relationships between the planar regions, along with domain knowledge regarding the possible position of the object in the scene to determine the corner vertices of the object and the occlusion of some of the object's planes, even if some of the range data is missing. The verification process is specific to the task of determining the position and orientation of an object or part of an object to receive a load in an earthmoving environment that is composed, to some extent, of planar surfaces. Further details of this embodiment of the object recognizor 36 is provided in the Assignee's copending application entitled, "*Method And Apparatus for Determining The Location, Dimension, And Orientation Of An Object*" (Attorney Docket No. 97-351), which was filed on the same day as the present application and is hereby incorporated by reference.

An alternative embodiment of the object recognizor 36 which may be incorporated with the present software architecture 18 involves recognizing and determining the location and orientation of an object, such as a dump truck, using incremental range data from a scanning sensor. The recognition method takes advantage of characteristics of data provided by scanning sensors along with the geometrical characteristics of objects that typically receive loads in an earthmoving environment, such as dump trucks. The data from a single scanline provided by a scanning sensor system is processed to determine if there are discontinuities in the scanline. The recognition method also takes advantage of the fact that discontinuities in adjacent scanlines should be in close proximity to each other and should correspond to dominant features in a model of the object. The top and bottom edges of an object, such as a dump truck bed and prominent changes in the terrain, can be located as discontinuities in a single scan line. These discontinuities are used to form possible interpretations of the object's position and orientation. As more scanlines are received, discontinuities that are in close proximity are given similar labels. Lines are also fit to the discontinuities and are compared to edges in one or more models that are possible interpretations of the object. Geometric constraints derived from the model are used to eliminate unfeasible interpretations and to confirm feasible interpretations. If a feasible interpretation can be formed, then the object of interest is assumed to be recognized. The best interpretation, based on the number of scanlines used and the most model features found, is processed to determine the best position and orientation of the object. As scanlines are received, the position and orientation of the object is continually updated and provided to other subsystems for controlling other machinery. An assumption may also be used regarding the general orientation of the object that receives the load with respect to the loading machine. The recognition method does not require a scan of the entire object and surrounding area before it can begin processing the data to determine the position and orientation of the object. Further details of this embodiment of the object recognizor 36 is provided in the Assignee's copending application entitled, "*Incremental Recognition of A Three-Dimensional Object*" (Attorney Docket No. 97-562), which was filed on the same day as the present application and is hereby incorporated by reference.

Motion Planners

A preferred embodiment of a motion planner 40 includes at least three sub-task motion planners. A sensor motion planner 42 plans the motions of the sensors based on a predefined sensor motion script and the current machine state. An excavation motion planner 44 is an algorithm designed to dig and capture a bucket of earth. A loading motion planner 46 plans and executes the machine motions for moving to the truck, unloading, and moving back to dig another load.

The motion planner 40 controls complex automated movement of a machine using pre-stored instructions, including at least one parameter, that generally defines the complex automated movement. The motion planner 40 determines a value for each parameter during the execution of the pre-stored instructions and may include a learning algorithm which modifies the parameters based on the results of previous work cycles so that the performance of the machine more closely matches the desired results. Parameters are used as needed to define changes in the complex automated movement as a result of work that is done or changes in the environment. For example, complex automated movement performed by an excavating machine can be affected by the movement, location, and orientation of objects around the machine. In addition, when the machine is performing work which involves moving material from one location to another, either the starting position or the destination may change, requiring changes in the movement. Sensors mounted on the machine or at some location within the machine's environment can be used to detect the starting and ending locations. The parameters in the instructions can be modified to maximize the efficiency of the complex automated movement. Parameters can be included in instructions, e.g., to determine when to begin movement of different linkages on the excavator linkages to obtain quick, efficient movement of the arm from when the material has been loaded until the material is deposited in the truck. Further details of a preferred embodiment of the motion planner 40 is provided in the Assignee's copending application entitled, "*Learning System And Method For Optimizing Control Of Autonomous Earthmoving Machinery*" (Attorney Docket No. 97-368), which was filed on the same day as the present application and is hereby incorporated by reference. A more detailed description on the use of parameterized scripts may also be found in the Assignee's copending application entitled, "*Automated System And Method For Control Of Movement Using Parameterized Scripts*", U.S. Ser. No. 08/796,824.

The motion planner 40 determines the movements required by the machine to accomplish designated tasks. In order to accomplish the tasks efficiently, the motion planner 40 may predetermine the response of the machine to a given set of motion commands generated by one of the sub-task motion planners, such as the sensor motion planner 42, the excavation motion planner 44, the loading motion planner 46, an obstacle detection planner 48, or any other type of sub-task motion planner 54 that contributes to accomplishing the required task. The outputs of the motion planner 40 may be sent to a machine controller 52 to drive one or more hydraulic pumps for moving actuators on a machine such as a hydraulic excavator. When two or more actuators are driven by a single hydraulic pump, there may not be adequate hydraulic pressure to drive both of the actuators at the speed requested by the sub-task motion planners 42, 44, 46, 48, 54. In order to determine the non-linear response of the actuators and the optimal combination of motions of the moving parts driven by the actuators, a controller for the machine is modeled as a linear dynamic system. The non-linear response of the actuators may be modeled using a look-up table that is a function of internal variables of the machine's actuators and hydraulic system. The number of input, or independent, variables that are supplied to the table look-up functions is proportional to the number of actuators being driven by a single pump. Sensors provide data regarding the internal state of each actuator including variables such as spool valve position and cylinder force. These variables are used to index into tables containing data that represents each actuator's constraint surface. The constraint surfaces are predetermined and are dependent on the state of the other actuators driven by the same pump. Further details of the modeling technique for the machine response are set forth in the Assignee's copending application entitled, "*Simulation Modeling Of Non-linear Hydraulic Actuator Response*" (Attorney Docket No. 97-366), which was filed on the same day as the present application and is hereby incorporated by reference.

In the sensor motion planner 42, a motion script can be used to guide the scan pattern and scan rate for one or more sensor systems as a function of the equipment's progress in the work cycle. The sensor motion planner 42 may send position and/or velocity commands to one or more of the sensor systems 24. The sensor motion planner 42 may acquire information regarding the actual state of one or more of the sensor systems 24 through the corresponding sensor interface 22.

The obstacle detection planner 48 uses sensor data from the terrain map server 28 and a prediction of the machine's future state to determine if there is an obstacle in the proposed path of motion. If there is, the obstacle detection planner 48 plans a path around the obstacle, executes the planned motion, and returns control to the motion planner 40.

A machine controller interface 50 provides an interface between controllers operably connected to the machine's movable components, and the rest of the software architecture 18. It translates commands expressed in radians, for example, to a form required by one or more of the machine controllers 52. It also provides a way to substitute between real hardware and a computer simulation of the machine for research and development purposes. Information regarding the actual state of the machine, including the position and velocity of movable components, cylinder pressures, and the position and orientation of the machine, may be sent from the machine controller 52 to the machine controller interface 50.

The sub-tasks discussed hereinabove are illustrative of a preferred embodiment of an integrated, modular software architecture for autonomous control of excavating machinery. Alternate tasks may require one or more sub-tasks in addition to or instead of those described hereinabove. The important aspect of the present invention is that it may be adapted to meet the specific requirements for many types of tasks and machinery. Logic portions of the sensor interfaces 22, the sensor pipeline 20, the sensor data consumers 30, and the planners 56 associated with the present invention, as well as the logic and data associated with the present software architecture 18, may be implemented in computer software, firmware, or hardware, or a combination of these. Any suitable means for transferring data among the components may be used, such as a data bus, radio, satellite, infrared, or cable transmission and reception means.

INDUSTRIAL APPLICABILITY

The above described invention is useful for automating hydraulic machines possessing a plurality of movable components, such as a hydraulic excavator. In many situations, the excavator must perform rapidly under high loading conditions such as digging into a soil face. The present software architecture coordinates the sensors, planners, and motion controllers, and allows for system growth by using a modular structure that is capable of supporting additional sensor systems, planning algorithms, and/or machine controllers.

A specific example of an earthmoving machine to which the present invention may be adapted is an excavator moving soil, stone, or other material from one location to another location, such as from a pile to a dump truck. As the material is moved from the pile, the starting point of movement of the arm of the excavator at the conclusion of digging will change. In addition, the trucks may vary in size, precise position, orientation relative to the excavator, etc. All such changes should be taken into account to maximize efficiency in transferring the material from the starting location to the truck with minimal spillage.

Figure 2:
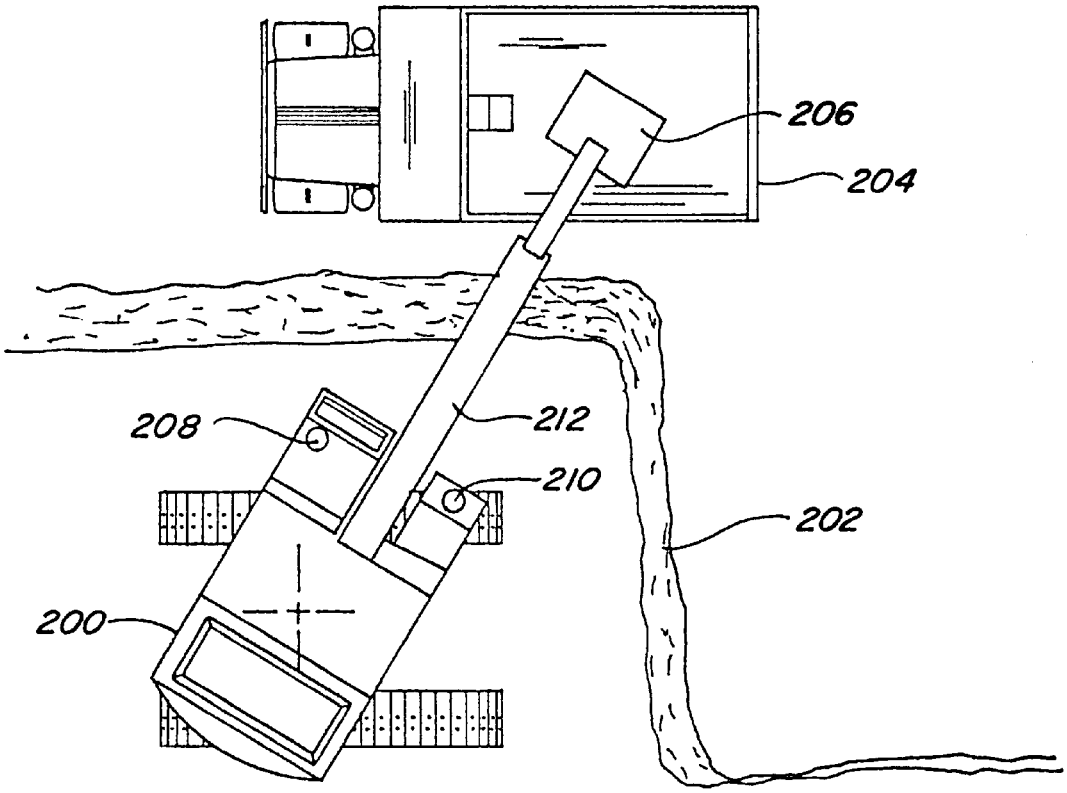
FIG. 2 is a top plan view of a typical excavation site with an excavator positioned above a dig face and a dump truck located within reach of the excavator's bucket.
Figure 3:
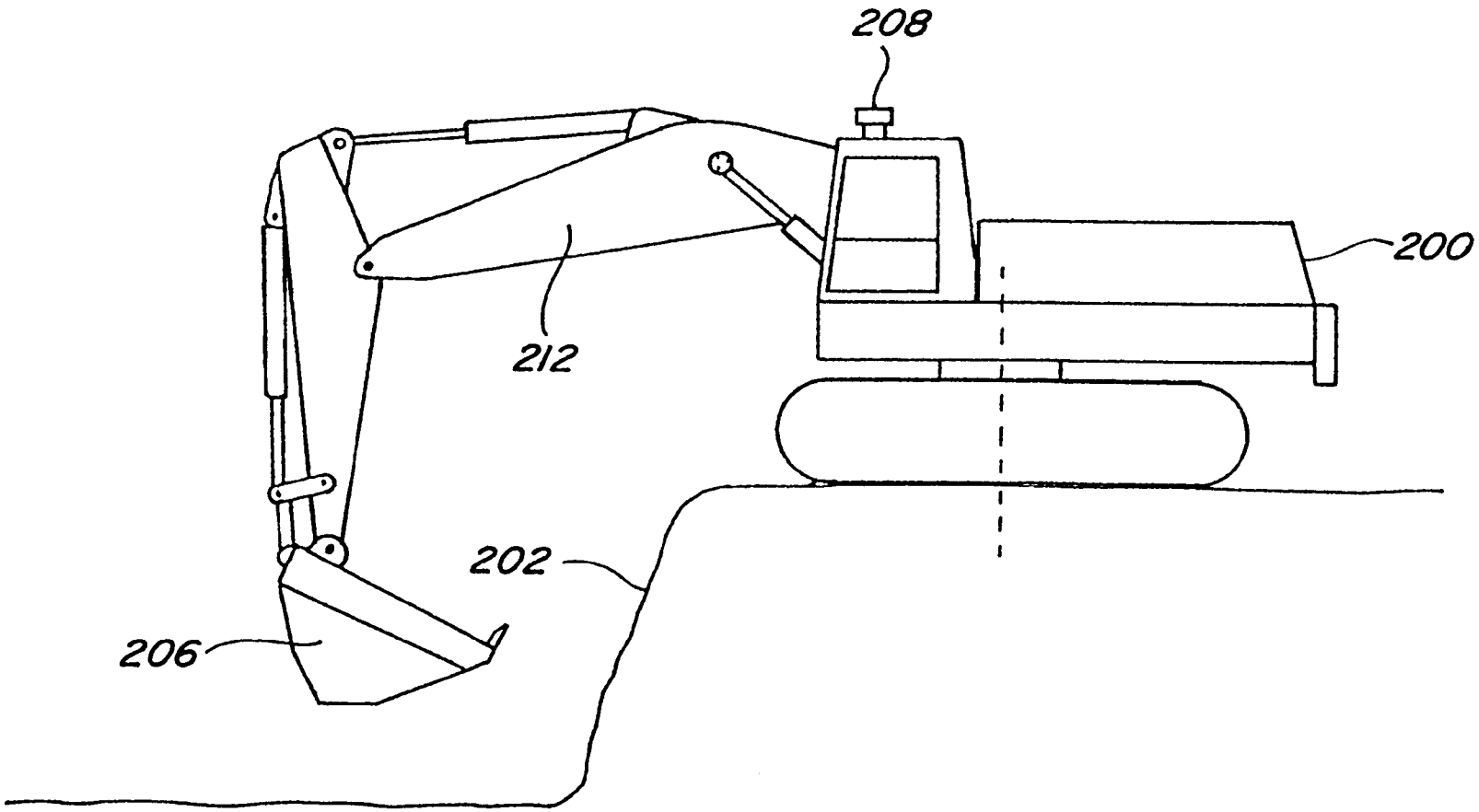
FIG. 3 is a side plan view of a typical excavation site with an excavator positioned above a dig face.

FIGS. 2 and 3 illustrate a typical excavation site with an excavator 200 positioned above a dig face 202, and a dump truck 204 located within reach of the excavator's bucket 206. In order for the excavator 200 to operate autonomously, the location of objects and obstacles within the excavator's area of movement, and the location of terrain to be excavated must be known. The sensor systems used must therefore be capable of providing current information regarding location of objects around the area of movement far enough in advance to provide the excavator 200 with adequate response time. Further details of a sensor configuration that may be used with the present software architecture are set forth in the Assignee's copending application entitled, "*Sensor Configuration For An Earthmoving Machine*" (Attorney Docket No. 97-348), which was filed on the same day as the present application and is hereby incorporated by reference.

FIG. 2 illustrates an implementation of the present invention with left and right sensors 208, 210 mounted at approximately symmetrical locations to the left and right of a boom 212 on the excavator 200. A dump truck 204 is positioned near the excavator 200 for receiving the excavated materials. During the digging and loading cycle, the sensor motion planner 42 commands the left and right sensors 208, 210 to monitor the bucket 206 and adjacent areas. As the excavator 200 nears completion of the digging process, the sensor motion planner 42 commands the left sensor 208 to pan toward the dump truck 204, and the obstacle detection planner 48 checks for obstacles in the path of movement of the excavator 200. The object recognizor 36 determines the position and orientation of the dump truck 204 for use by the loading point planner 34. After completing the loading cycle, the motion planner 40 coordinates the scan speed of the sensor 210 with the pivotal rotation of the excavator 200 as it returns the boom 212 toward the dig face 202 to detect obstacles far enough in advance to allow adequate response time for the excavator 200.

The left and right sensors 208, 210 may be operated independently to improve efficiency. For example, as the excavator 200 swings toward the dump truck 204, the right sensor 210 retrogrades (i.e., pans in the opposite direction) to scan the excavated area to provide data for planning the next portion of the excavation. At the same time, the left sensor 208 scans the area around the dump truck 204. The left sensor 208 provides current information to the loading point planner and the motion planner 40 to allow the loading point planner 34 to determine an accurate location to unload the bucket 206, even if the dump truck 204 moved since the last loading cycle. While the bucket 206 is being unloaded, the sensor motion planner 42 commands the right sensor 210 to scan the area near and to the right of the bucket 206 to prepare for rotating toward the dig face 202. As the excavator 200 rotates to the right, the right sensor 210 pans ahead toward the dig face 202 to provide information for the obstacle detection planner 48. When the excavation motion planner 44 commands the excavator 200 to rotate toward the dig face 202 after unloading, the sensor motion planner commands the left sensor 208 to retrograde to view the distribution of soil in the bed of the dump truck 204 to provide information to the loading point planner to determine the location in the bed to unload the next bucket of material. As the bucket 206 arrives near the dig face 202, the sensor motion planner 42 commands the right sensor 210 to scan the excavation area to provide information to the excavation point planner 32. Once the left sensor 208 completes its scan of the dump truck 204, the sensor motion planner 42 commands the sensor 208 to also scan the digging area. The steps in the excavating process are repeated as outlined above until the motion planner 40 determines that the dump truck bed is filled or the excavation is completed. The sensor data consumers 30 and the planners 56 use information provided by the sensor systems 24 to the terrain map server 28 to determine whether operations should be halted, such as when the dump truck 204 is filled, the excavation is complete, or an obstacle is detected. The information is also used to navigate movement of the equipment.

The application of the present invention to excavating and loading operations is illustrative of the utility of the software architecture disclosed in the present invention. In addition to excavators, the present invention may be applied to other earth moving machinery such as wheel loaders, track-type tractors, compactors, motor graders, agricultural machinery, pavers, asphalt layers, and the like, which exhibit both (1) mobility over or through a work site, and (2) the capacity to alter the topography or geography of a work site with a tool or operative portion of the machine such as a bucket, shovel, blade, ripper, compacting wheel and the like.

Other aspects, objects and advantages of the present invention can be obtained from a study of the drawings, the disclosure and the appended claims.

What is claimed is:

1. A software architecture for autonomous control of earthmoving machinery comprising:

at least one sensor system operable to provide data regarding pertinent regions of the environment of the earthmoving machinery;

a sensor pipeline operable to receive data from the at least one sensor system and to distribute the data to components in the software architecture;

at least one sensor data consumer operable to plan an earthmoving task using the data including recognizing objects in the environment, selecting a location to excavate, and selecting a location to place the excavated material; and at least one motion planner operable to generate commands to independently move components of each of the at least one sensor system and the machinery to concurrently plan and execute phases of the earthmoving task.

2. The software architecture as set forth in claim 1 wherein the sensor pipeline further comprises a terrain map server, the terrain map server being operable to receive at least a portion of the data, to process at least a portion of the received data to generate a terrain map of at least a portion of the earthmoving environment, and to distribute at least a portion of the terrain map upon request to at least one component in the software architecture.

3. The software architecture as set forth in claim 2 wherein the sensor pipeline includes at least one sensor interface operable to receive data from the at least one sensor system and to transmit commands for controlling movement of the at least one sensor system to the at least one sensor system.

4. The software architecture as set forth in claim 3 wherein the sensor pipeline includes at least one scan line processor operable to receive data from the at least one sensor interface, to transform the data from one coordinate system to another, and to transmit the transformed data to the terrain map server.

5. The software architecture as set forth in claim 4 further comprising:

a position system operable to transmit data regarding the position of the earthmoving machine to the at least one scan line processor.

6. The software architecture as set forth in claim 3 wherein the motion planner further comprises at least one sub-task, the at least one sub-task being operable to receive data from the at least one sensor interface and to transmit commands to the at least one sensor interface to control the motion of the at least one sensor system.

7. The software architecture as set forth in claim 2 wherein the at least one sensor data consumer is operable to use terrain map data to determine a location for executing the earthmoving task.

8. The software architecture as set forth in claim 2 wherein the at least one sensor data consumer is operable to use terrain map data to determine a location for unloading excavated material collected by the earthmoving machinery.

9. The software architecture as set forth in claim 2 wherein the at least one sensor data consumer is operable to use terrain map data to determine if an object is present in the earthmoving environment.

10. The software architecture as set forth in claim 2 further comprising a machine controller interface operable to receive a command from the motion planner and data from a machine controller, and to transmit the command to the machine controller and the data to the motion planner.

11. The software architecture as set forth in claim 10 wherein the motion planner is further operable to receive data from the at least one sensor data consumer and to transmit commands to the machine controller interface to control the motion of the earthmoving machine.

12. The software architecture as set forth in claim 11 further comprising:

an obstacle detection planner being operable to receive data from the terrain map server, the machine controller interface, and the motion planner, the obstacle detection planner being further operable to transmit data to the machine controller interface and the motion planner.

13. The software architecture as set forth in claim 1 wherein the motion planner uses operational constraints of the earthmoving machinery to generate commands to move components of the machinery to perform the earthmoving task.

14. The software architecture as set forth in claim 1 wherein the motion planner uses geographic constraints associated with the earthmoving environment to generate commands to move components of the earthmoving machinery to perform the earthmoving task.

15. A software architecture for autonomous control of earthmoving machinery including at least one sensor system comprising:

a motion planner including a plurality of sub-tasks, the sub-tasks including at least a sensor motion planner, an earthmoving motion planner, and a loading motion planner, the sub-tasks being operable to pre-plan and coordinate phases of an earthmoving task and to generate commands to independently move components of each of the at least one sensor system and the earthmoving machinery to perform the earthmoving task.

16. The software architecture as set forth in claim 15 further comprising:

an obstacle detection planner operable to coordinate with the plurality of sub-tasks to control the earthmoving machinery to prevent interference with any obstacles detected in an earthmoving environment.

17. A software architecture for autonomous control of earthmoving machinery comprising:

at least one sensor system operable to provide data regarding pertinent regions of the environment of the earthmoving machinery;

a sensor pipeline operable to receive data from the at least one sensor system and to distribute the data to components in the software architecture;

at least one sensor data consumer operable to plan an earthmoving task using the data including recognizing objects in the environment, selecting a location to excavate, and selecting a location to place the excavated material; and at least one motion planner operable to generate commands to independently move components of each of the at least one sensor system and the machinery to concurrently plan and execute phases of the earthmoving task;

said sensor pipeline including at least one sensor interface operable to receive data from said at least one sensor system and to transmit commands for controlling movement of said at least one sensor system to said at least one sensor system.

* * * * *